US008885443B2

(12) United States Patent
Marzouq

(10) Patent No.: US 8,885,443 B2
(45) Date of Patent: Nov. 11, 2014

(54) APPARATUS FOR MAKING ASTRONOMICAL CALCULATIONS

(76) Inventor: Rashed Farhan Sultan Marzouq, AL-Jabriah (KW)

( * ) Notice: Subject to any disclaimer, the term of this patent is extended or adjusted under 35 U.S.C. 154(b) by 463 days.

(21) Appl. No.: 13/236,798

(22) Filed: Sep. 20, 2011

(65) Prior Publication Data

US 2013/0070567 A1 Mar. 21, 2013

(51) Int. Cl.

| | |
|---|---|
| ***G04B 19/26*** | (2006.01) |
| ***G04G 9/02*** | (2006.01) |
| ***G04G 9/00*** | (2006.01) |

(52) U.S. Cl.

CPC ..... *G04G 9/025* (2013.01); *G04G 9/0076* (2013.01)

USPC ..... 368/16

(58) Field of Classification Search

CPC ..... G04B 19/26

USPC ..... 368/15–18

See application file for complete search history.

(56) References Cited

U.S. PATENT DOCUMENTS

| | | | | |
|---|---|---|---|---|
| 4,215,410 | A * | 7/1980 | Weslow et al. | 700/61 |
| 4,435,640 | A * | 3/1984 | Micheletto | 235/78 M |
| 4,551,027 | A * | 11/1985 | Spruck | 368/15 |
| 4,825,426 | A * | 4/1989 | Oechslin | 368/15 |
| 5,208,790 | A * | 5/1993 | Sato | 368/15 |
| 5,574,465 | A * | 11/1996 | Okada | 342/352 |
| 6,680,693 | B2 * | 1/2004 | Urban et al. | 342/357.64 |
| 6,901,032 | B1 * | 5/2005 | Eo et al. | 368/15 |
| 7,230,883 | B2 | 6/2007 | Marhic et al. | |
| 2009/0190443 | A1 * | 7/2009 | Huizi et al. | 368/10 |

OTHER PUBLICATIONS

Earth System Research Laboratory website printout <http://www.esrl.noaa.gov/gmd/grad/solcalc/> printed Jan. 22, 2014.*

* cited by examiner

*Primary Examiner* — Amy Cohen Johnson

*Assistant Examiner* — Jason Collins

(74) *Attorney, Agent, or Firm* — Lowe Hauptman & Ham, LLP

(57) ABSTRACT

An apparatus for making astronomical calculations includes a calculator, mechanism and/or program for determining the time for sunrise and sunset on a specified date and time at a specific longitude and latitude. The apparatus also includes a mechanism and/or program for calculating the moonrise and moonset at the aforementioned date, time and location.

1 Claim, 5 Drawing Sheets

*Moonrise and moonset*

| ***Method*** | ***Example*** |
|---|---|
| 1. Calculate the coordinates of the Moon's centre for the midnight at the beginning of this date (§ 65) | $\lambda_1$ = 287.417 850 degrees<br>$\beta_1$ = -4.973 812 degrees<br>$\alpha_1$ = 19.306 463 hours<br>$\delta_1$ = -27.237 575 degrees |
| 2. Find the coordinates 12 hours later (§ 66) | $\lambda_2$ = 294.548 912 degrees<br>$\beta_2$ = -5.127 273 degrees<br>$\alpha_2$ = 19.831 899 hours<br>$\delta_2$ = -26.256 598 degrees |
| 3. Calculate the local sidereal times of rising and setting for these two positions (§ 33) | $LST1_r$ = 15.173 215 hours<br>$LST1_s$ = 23.439 712 hours<br>$LST2_r$ = 15.614 419 hours<br>$LST2_s$ = 0.049 378 hours |
| 4. Convert these local sidereal times to Greenwich sidereal times (§ 15). If GST1 is greater than GST2, add 24 to GST2. | $GST1_r$ = 19.909 881 hours<br>$GST1_s$ = 4.176 379 hours<br>$GST2_r$ = 20.351 086<br>$GST2_s$ = 4.786 045 hours |
| 5. Calculate the Greenwich sidereal time, T00, at 0h UT of this date. Use § 12 with UT = 0. | T00 = 10.895 617 hours |
| 6. Calculate the Greenwich sidereal time, T00', at 0h on the observer's longitude as follows: express the longitude in decimal degrees ( *W* negative), divide by 15, multiply by 1.002 738, and subtract the result from T00. If the result is negative, add 24. If the result is more than 24, do *not* subtract 24. | T00' = 15.909 306 hours |
| 7. If GST1 is less than T00', then add 24 to both GST1 and GST2 . | $GST1_r$ = 19.909 881 hours<br>$GST1_s$ = 28.176 379 hours<br>$GST2_r$ = 20.351 086 hours<br>$GST2_s$ = 28.786 045 hours |
| 8. Apply the formula $GST = \frac{12.03 \times GST1 - T00(GST2 - GST1)}{12.03 + GST1 - GST2}$ to the pairs of values for rising and setting. | $GST_1$ = 20.253 069 hours<br>$GST_2$ = 29.098 900 hours |
| 9. Calculate the correction, $\Delta_t$ (§ 33) due to parallax (subtractive; § 69), refraction (additive; § 37), and the Moon's finite diameter (additive; § 69). Use the average value of and $\delta_2$ , given by $\delta' = (\delta_1 + \delta_2)/2$ . | $\delta'$ = -26.747 086 degrees<br>$\pi$ = 0.989 464 degrees<br>$\theta_2$ = 0.269 613 degrees<br>$\chi$ = $-\pi + \theta/2 + 34'$<br>$\chi$ = -0.153 185 degrees<br>$y$ = -0.233 454 degrees<br>$\psi$ = 41.008 251 degrees |
| 10. Convert $\Delta_t$ to hours by dividing by 3600; add this to $GST_2$ and subtract it from $GST_1$ . | $\Delta_t$ = -62.742 245 seconds<br>$\Delta_t$ = -0.017 428 hours |
| 11. Convert these Greenwich sidereal times to UT, and then to local civil time (in this case Eastern Standard time; §§ 13 and 10). | $GST_r$ = 20.270 498 hours<br>$GST_s$ = 29.081 472 hours<br>$UT_r$ = 9.349 284 hours<br>$UT_s$ = 18.136 200 hours<br>$EST_r$ = **4h 21m**<br>$EST_s$ = **13h 08m** |

FIG. 5

APPARATUS FOR MAKING ASTRONOMICAL CALCULATIONS

FIELD OF THE INVENTION

This invention relates to an astronomical calculator and more particularly to an apparatus for making astronomical calculations for determining the time for sunrise and sunset, sun azimuth at sunrise and sunset, moonrise and moonset.

BACKGROUND FOR THE INVENTION

For many years mariners, navigators, Naval Officers, astronomers and amateur astronomers have calculated the positions and visual aspects of the major heavenly bodies and important phenomena such as eclipses. As reported in a forward to the book "Astronomical Formulae for Calculators" by Jean Meeus, published by Willmann-Bell Inc., Richmond Va. 23235, copyright 1982, 1985, 1988 "Over one hundred fifty years ago . . . young Charles Babbage at the University of Cambridge in England became infuriated at the number of errors he found in some astronomical tables . . . . He wished they had been produced by steam machines instead of by humans, then his friend John Herschel replied, It is quite possible!".

"In the early 1950's soon after the first "electronic brains" were constructed, their earliest applications included the wholesale calculations of tables and ephemeredes for the astronomical almanacs." More recently, as a Naval Officer, the applicant on a daily basis used books and tables to do astronomical calculations to determine sunrise/sunset, sun azimuth at sunrise and sunset and moonrise and moonset times. The problem was that the calculations everyday using books and tables took time and considerable effort.

As a result, Applicant conducted research in an effort to minimize such work and to find the easiest way to update such calculations. These calculations and updated calculations are important because they give a navigator the exact time for switching on and turning off a ships navigational lights and checking the gyro compass. The Applicant found a number of online programs and astronomical software, but such software and programs were not practical for many mariners and navigators because they required either internet and/or a computer.

More recently a patent search disclosed of Perkins, U.S. Pat. No. 4,111,184. As disclosed therein a parabolic reflector is supported so that it can track the sun. The support for this reflector comprises an azimuth frame supported on two wheels and a central pivotal point which are positioned in a substantially triangular configuration. The two wheels rotate on tracks. On top of the azimuth frame, there is provided an elevation frame. The elevation frame includes curved rails which define a portion of an arc and extend vertically. The reflector rides on wheels captured within the curved rails. The wheels of the azimuth frame are driven by an azimuth actuator. The reflector structure is counterbalanced about its elevations axis by a pendulum cable system which is driven by a motor to change elevation. At the focal point of the parabolic reflector, a heat engine or receiver is mounted independently on the reflector. Suitable means are provided for moving the reflector about its two axes in order to track the sun.

A more recent U.S. Pat. No. 4,215,410 of Weslow et al. discloses an open loop servo controller for controlling motors which drive a solar energy utilizing device about its azimuth and altitude axis to track the sun. The controller has a central processor and elements for inputting data corresponding with the present day of the year, the hour of the day, the minute of the hour and with the latitude and longitude of the device's installation. Memories store program data, and tables of data corresponding with the declination of the sun on any day and of other mathematical functions. The processor uses the data to calculate the azimuth and altitude angles of the sun itself within every minute of the day and causes signals to be produced which result in motor controllers causing the motor to turn the device through the azimuth and altitude axes angles corresponding with the calculated angles.

Notwithstanding the above, it is presently believed that there is a need and a potential commercial market for an astronomical calculator in accordance with the present invention. There should be a need and potential market for such devices because they provide the basic calculations for a navigator, namely sunrise, sunset, moonrise, moonset, and sun azimuth at sunrise and sunset. In addition, the apparatus is light and small, about 7 cm by 10.5 cm in length and width with a relatively thin thickness. The device can be used in any position on earth for any period of time between the years 1583 and 9999 AD. Further, the apparatus is durable, has reasonable battery life and can be manufactured and sold at a reasonable price.

BRIEF SUMMARY OF THE INVENTION

In essence, an apparatus for making astronomical calculations according to the present invention includes first calculating means for determining the time for sunrise and sunset on a given date at a specific longitude and latitude. The apparatus also includes second calculating means for determining the sun azimuth at sunrise and sunset on the selected date at the specified longitude and latitude. Further, the apparatus or device includes third calculating means for determining the time of moonrise and moonset on the given date and at the specified longitude and latitude.

With respect to the above, the calculations are based on the following elements, Julian Days, Universal time, Sideral time, Greenwich Sideral time, formula for rising and setting of a celestial object. In addition, the sun's right ascension, sun's declination, sun's refraction and sun's position are used. For moonrise and moonset the formula for rising and setting of a celestial object, geocentric parallax and figure of the earth, corrections for parallax, moon's right ascension, moon's hourly motion, moon's position and moon's declination are used.

An equation for calculating sunrise/sunset is as follows:

$$\mathrm{Cos}(H) = \frac{\mathrm{Sin}(a) - \mathrm{Sin}(\varphi) * \mathrm{Sin}(\delta)}{\mathrm{Cos}(\varphi) * \mathrm{Cos}(\delta)}$$

To calculate the sunrise/sunset time an individual needs to know:

1. Sun's declination (δ)
2. Position latitude (ϕ)/longitude (to know time difference from Greenwich)
3. Sun's altitude from the horizon at sunrise (−00°50') (a) This is a standard that never changes.
4. Meridian: half of a great circle which terminated at the north and south poles. On the meridian is a line of longitude. On the celestial sphere, the meridian which passes through the zenith is called the observers meridian.

The invention will now be described in connection with the accompanying drawings wherein like reference numerals have been used to indicate like parts.

DESCRIPTION OF THE DRAWINGS

FIG. 5 is a descriptive illustration of a method in accordance with the invention.

DESCRIPTION OF THE PREFERRED EMBODIMENTS OF THE INVENTION

Figure 1:
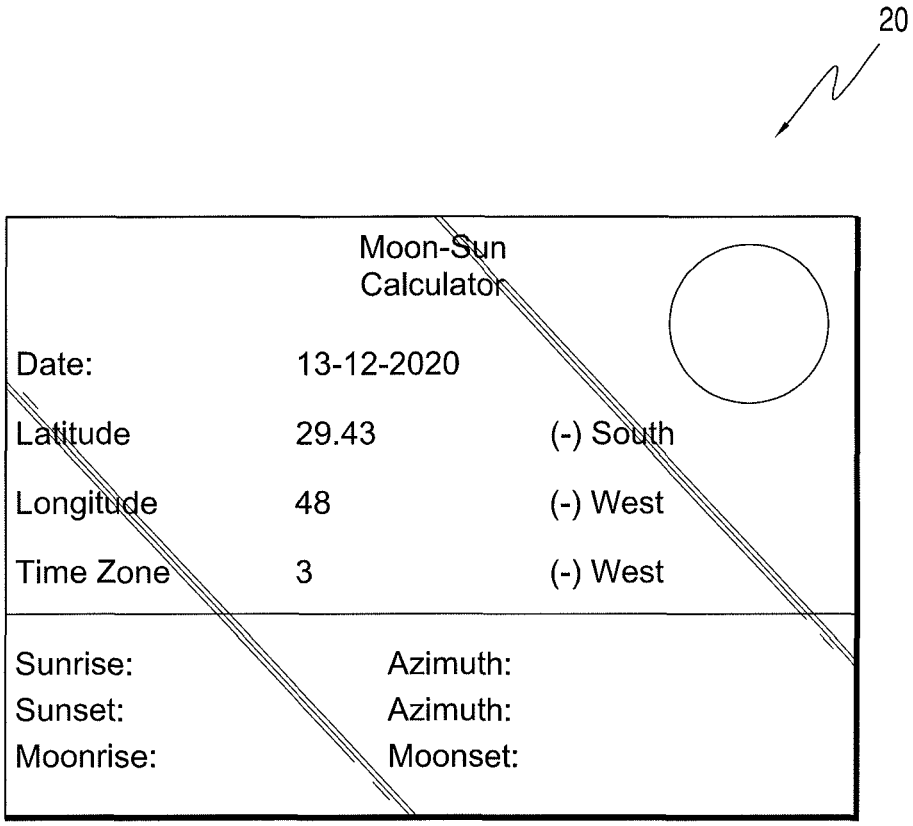
FIG. 1 is a schematic illustration of a calculator screen in accordance with a first embodiment of the invention.
Figure 2:
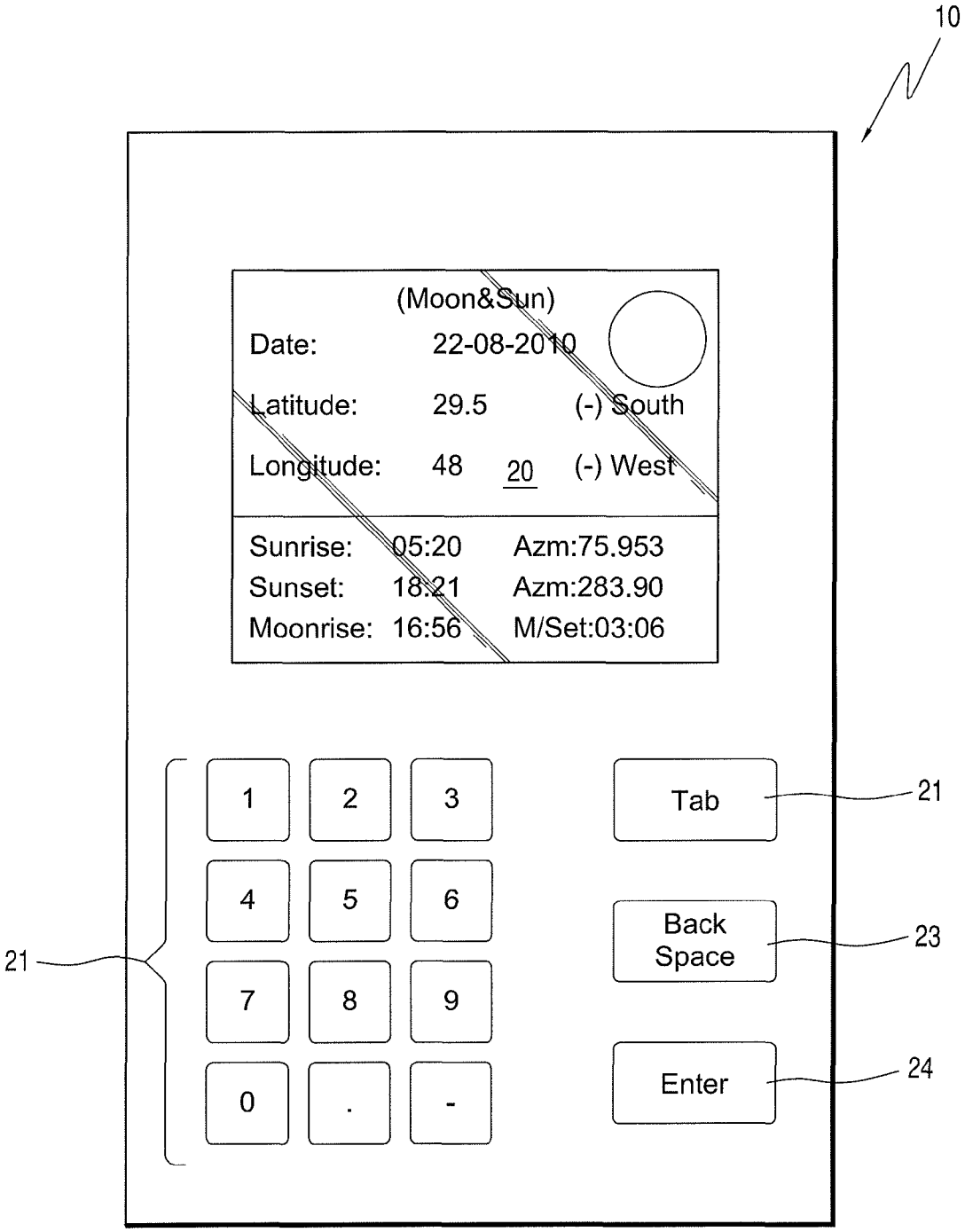
FIG. 2 is a schematic illustration of a calculator according to a first embodiment of the invention.

As illustrated in FIGS. 1 and 2, a calculator 10 in accordance with the present invention has the dimension of about 7 cm by 10.5 cm and includes a main screen 20, keypad 21, a tab key 22, a backspace key 23 and an enter key 24.

A source code for practicing the invention is available on the Internet and identified as eclipse library (www.libnova.sf.net). It is a free code that includes the entire solar system calculations. The selected code is rewritten again in a program called "source inside." It is a C language program. This program can be used and operated in rock chip. All calculations and formulas are interconnected. For example, you cannot obtain the sunrise/sunset times unless you obtain the declination and you can not get the declination unless you know or calculate the Julian Day. The declination and calculation of the Julian Day is set forth in the book Practical Astronomy With Your Calculator Third Addition, by Peter Duffett-Smith, and in Libnova. Celestial Mechanics, Astronomy and Astrodynamic Library, the contents of both of which are incorporated herein in their entirety.

As set forth in the Libnova website, Libnova is a general purpose, double precision, celestial mechanics, Astrometry and Astrodynamics library. The intended audience of Libnova is C/C++ programmers, astronomers and anyone else interested in calculating positions of astronomical objects or celestial mechanics. Libnova is the calculation engine used by the Nova project and importantly, is free software. The current version of Libnova can calculate Julian Day, Sideral Time, Lunar Positions (using ELP82), phase angle, Rise, Set and Transit Times, Hyperbolic motion of bodies, etc.

As shown in FIG. 1, the screen includes a plurality of text boxes and minimal instruction of data for example; an individual using the device enters the date, month and year 25 as well as the latitude 26, longitude 27 and time zone 28. As shown, the screen also includes directions after latitude to use a minus sign if South of the equator and a minus sign if in a Western quadroon as well as the time zone. Then after entering Enter the screen shows the time for sunrise, sunset, moonrise and moonset as well as the sun's azimuth at sunrise and sunset. As shown, the day, month and year are entered using two digits for the day, two digits for the month and four digits for the year. A dash button is also used to separate the month, day and year.

Figure 3:
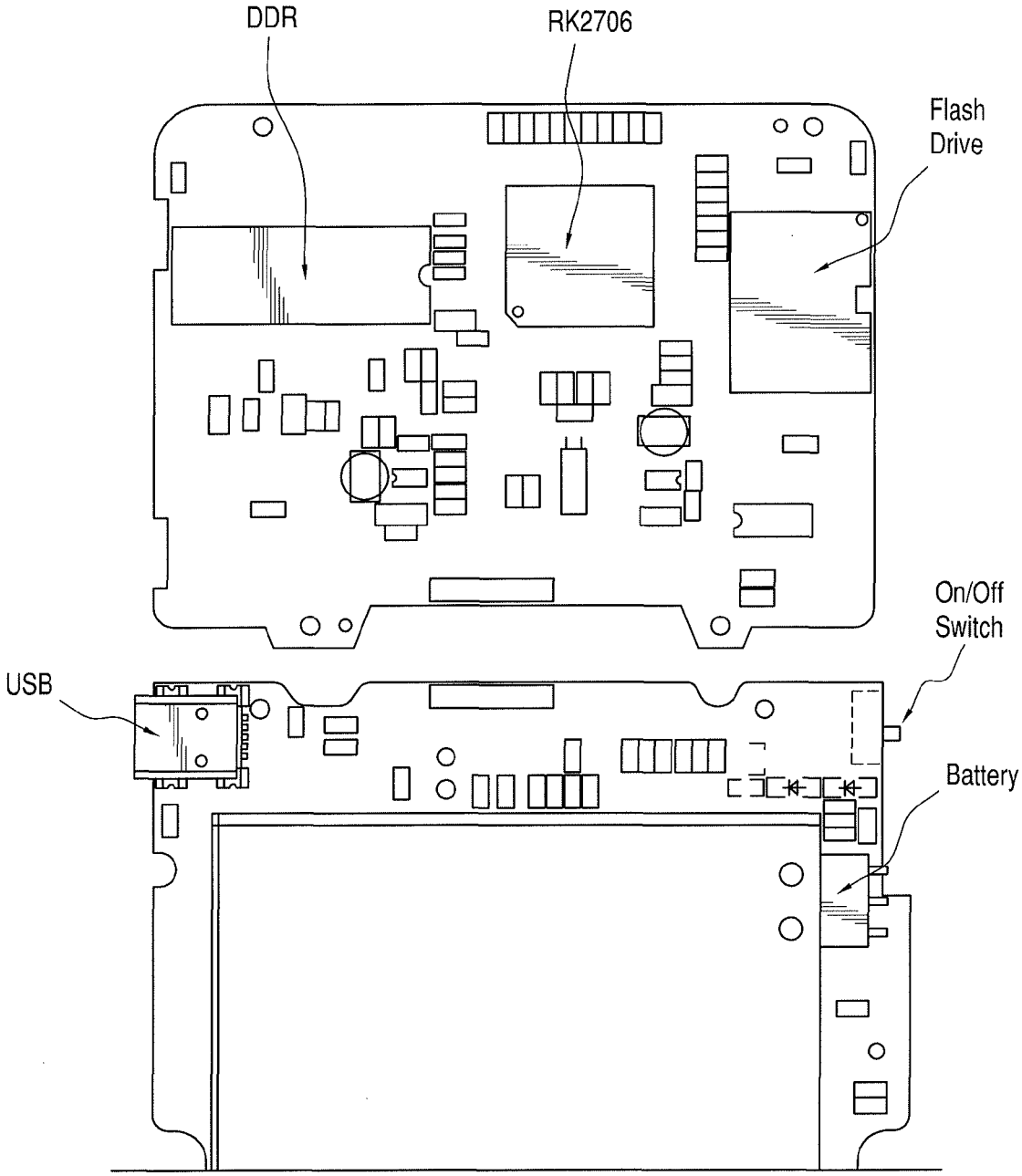
FIG. 3 is a schematic illustration of the key elements in accordance with a preferred embodiment of the invention.

As shown in FIG. 3, the calculator hardware structure includes a main chip (RK2706) for data processing and program instruction execution. The control of 12C: communication control in recent years in the field of microelectronics is widely used in a new bus standard. It is a special form of synchronous communication with the interface cable less control simplifies the device package. It also has the advantages of high speed communication.

Serial Peripheral Interface (SPI) is used in the EEPROM, FLASH, real time clock, AD converter, as well as digital signal processor and digital signal between the decoders. SPI communication coordinate the work of each module. The chip is a dual core chip by the ARM core and digital signal processing (DSP) core component, ARM core is mainly used for address translation addressing data processing and computer instruction execution and also responsible for data access control and so on. DSP core is mainly used for audio and video signal processing.

Double Data Rate (DDR) synchronous dynamic random access memory is equivalent to the computer's memory as a cache key used to store programs that are running some of the data. Power-down after the data is cleared 1.3 (FIG. 3) is a flash drive and serves as the computer's hard disc for data storage. Please note the 1.4 is a USB input while 1.5 is an on/off switch. Further, a battery 1.6 is a lithium 3.7 volt battery while 1.7 indicates the main screen in FIG. 3.

Hardware initialization requires initializing the various hardware modules to produce a working state including the master and 12C, SPI chip, DDR flash modules to do the reverses. The hardware initialization process operates the work in the software before the hardware system is in a need to work state so that all memory modules including 12C, SPI communications are in working condition (specifically, to initialize the chip state of all registers, initialization level of each pen, the chip in the communication state, making the screen flash and other devices are in a state so that data can be read.)

In each hardware module initialization into the normal operating mode the software starts to read some of the defaults system parameters, the data for the calculator to do the reserves.

The drivers of each hardware module includes the driver DDR flash drive, screen display driver and the key driver screen driven by way of 12C communication through the screen of the driver IC 12C write register commands to control screen display output. AD port scan on access to key state.

Then, to carry out a major work load the Graphical User Interface (GUI) provides a design for a part of a program that interacts with the user's icons to represent program features. The GUI then reads the system data needed and text information is displayed on the screen.

These are the elements used to calculate sunrise/sunset time and sun azimuth. The elements include Julian Day, UT Universal Time, Sidereal Time, GST Greenwich Sidereal Time, rising and setting of any celestial object, Sun's right ascension, Sun's declination, Sun's refraction and Sun's position. For calculating the moon rise/moon set the elements include rising and setting of any celestial object, Geocentric parallax and figures of the earth, Calculating corrections for parallax, Moon's right ascension, Moon's hourly motion, Moon's position, and Moon's declination.

As shown in FIG. 2 a calculator screen includes a plurality of text boxes 21-26 for entering the data that includes two digits for entering the day, two digits for entering the month and four digits for entering the year between 1584 and 5000 AD. The text box 21 is connected to a arcade 2706 chip (a main chip) that is used for data processing and program instruction execution. Latitude text box is used and the screen indicates that if your position is south of the equator press (–) before digits. With respect to longitude text box press (–) before digits and once again if your position is west press (–) before entering digits. Further if your position is west press (–) before the digits with respect to the time zone text box and finally sunrise/sunset, moonrise/moonset time and sun azimuth at sunrise sunset are produced after pressing enter.

The operation of the calculator in accordance with a first embodiment of the invention starts with calculator/software. In the preferred embodiment of the invention the calculator is powered by a lithium ion 3.7V battery and includes a screen, a keypad and a tab button for moving forward between text boxes. The calculator also includes a backspace key to clear the text boxes and an enter button to obtain the results of the calculation as well as an on/off power button and a USB port for receiving a flash drive.

In the operation of the device the mariner or navigator enters the longitude and latitude at a specified date and enters the Julian date, universal time, Sideral time, Greenwitch Sideral time, formula for rising and setting of a celestial body, sun's right ascension, sun's declination, sun's refraction and sun's position; and for moonrise and moonset, the geocentric parallax and figure of the earth, corrections for parallax, moon's right ascension, moon's hourly motion, moon's position and moon's declination.

After entering the above, the sun's coordinates are calculated in box 56 and after that the sunrise and sunset are calculated for the entered longitude and latitude on the specified date in step 60. At this stage a calculation using the sun's coordinates for two midnights and straddling the specified time by the following formula:

$$T = \frac{24.07 \times ST1}{24.07 + ST1 - ST2}$$

Figure 4:
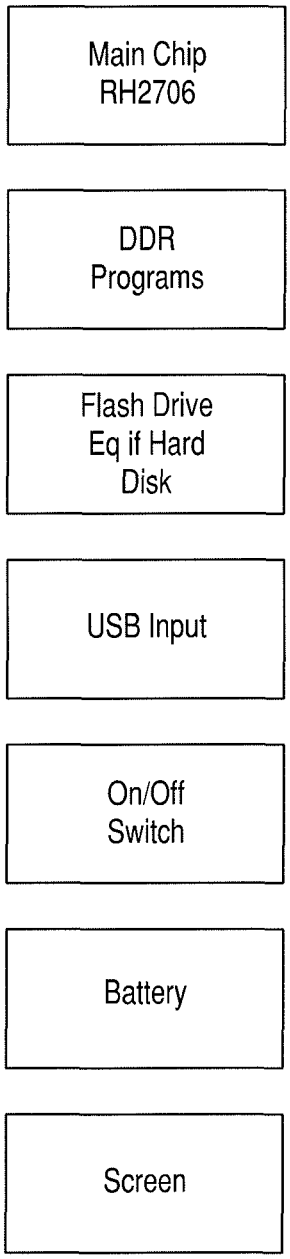
FIG. 4 is a block diagram showing the key elements in accordance with a preferred embodiment of the invention.

The use of an astronomical calculator in accordance with the present invention will now be described in connection with FIG. 4 wherein the process includes the following steps. For example, step 1 indicated by box 50 calls for providing a calculator/software with a RK2706 main chip for data processing and program indication with control of 12C communication, SP1 communication and control of each module.

The following calculations are examples of the main source code of the calculator's software. It is written in C language inside a program called source inside. The source code consists of 2431 lines in total. The source code is available online at www.libnova.sf.net and is incorporated herein in its entirety by reference and readily incorporated by a programmer of ordinary skill in the art.

EXAMPLES

```
• Take the day, month, year and hours in the day and returns the
modified Julian day number defined as mjd = jd − 2400000.5
double a, b, c, d, e, f;
    if (month <= 2)
        {month = month + 12;
        year = year − 1;}
    a = 10000.0 * year + 100.0 * month + day;
    if (a <= 15821004.1)
        {c = (year + 4716) / 4;
        b = −2 * floor(c) − 1179;}
    else
        {d = year / 400;
        e = year / 100;
        f = year / 4;
        b = floor(d) − floor(e) + floor(f);}
    a = 365.0 * year − 679004.0;
    return (a + b + floor(30.6001 * (month + 1)) + day + hour / 24.0);
double ut(double h, double m, double z)
    {return (h − z + m / 60);}
```

-continued

```
double jd(double y, double m, double d, double u)
    {return (367 * y) − floor((7.0 /4.0) * (floor((m + 9) / 12) + y)) +
floor(275 * m / 9) + d − 730531.5 + (u / 24);}
double azimuth(double Ig, double la, double ye, double mo, double
da, double ho, double ml, double zo)
    {double uu, jj, TT, k, M, Lo, DL, L, eps, delta, RA, GMST, LMST,
    H, eqt, azm;
    double cc = 0;
    uu = ut(ho, mi, zo);
    jj = jd(ye, mo, da, uu);
    TT = jj /
    36525; k k =
    PI / 180.0;
    M = 357.5291 + 35999.0503 * TT − 0.0001559 * TT * TT −
    0.00000045 * IT * TT * TT; cc = (int)M % 360;
    M = M − (long)(M / 360) * 360; //(int)M % 360;
    Lo = 280.46645 + 36000.76983 * TT + 0.0003032 * TT * TT;
    cc = (int)Lo % 360;
    Lo = Lo − (long)(Lo / 360) * 360; //(int)Lo % 360;
    DL = (1.9146 − 0.004817 * TT − 0.000014 * TT * TT) * sin(k *
    M) + (0.019993 − 0.000101 *
TT) * sin(k * 2 * M) + 0.00029 * sin(k * 3 * M);
    L = Lo + DL;
    eps = 23.43999 − 0.013 *TT;
    delta = (1 / k) * asin(sin(L * k) * sin(eps * k));
    RA = (1 / k) * atan2(cos(eps * k) * sin(L * k), cos(L * k));
    cc = (int)(RA + 360) % 360;
    RA = RA + 360− (long)((RA + 360)/ 360) * 360; //(int)(RA +
    360) % 360;
    GMST = 280.46061837 + 360.98564736629 * jj + 0.000387933 *
    IT * TT − TT * IT * TT /
38710000;
    cc = (int)(GMST + 360) % 360;
    GMST = GMST + 360 − (long)((GMST + 360)/ 360) *
    360;//(int)(GMST + 360) %
    360; LMST = GMST + Ig;
    H = LMST − RA;
    eqt = (Lo − RA) * 4;
    azm = (1 / k) * atan2(−sin(H * k), cos(la * k) * tan(delta * k) −
    sin(la * k) * cos(H * k));
    cc = (int)(azm + 360) % 360;
    azm = (azm + 360) − (long)((azm + 360)/ 360) * 360;
    //(int)(azm + 360) % 360;
    return azm;
• Takes the mean Julian day and the longitude (west negative) and then
returns the local sidereal time in hours.
double 1st, t, d;
d = mjd − 51544.5;
t = d / 36525.0;
1st = range(280.46061837 + 360.98564736629 * d + 0.000387933
*t*t−t*t*t/ 38710000);
return (1st / 15.0 + glon / 15);
• returns the right ascension and declination of the Sun in an
array in decimal hours, degrees
    double p2 = 6.283185307, coseps = 0.91748, sineps = 0.39778;
    double L, M, DL, SL, X, V. Z, RHO, ra, dec;
    M = p2 * frac (0.993133 + 99.997361 * t);
    DL = 6893.0 * sin(M) + 72.0 * sin(2 * M);
    L = p2 * frac (0.7859453 + M / p2 + (6191.2 * t + DL) /
    1296000);
    SL = sin(L);
    X = cos(L);
    Y = coseps * SL;
    Z = sineps * SL;
    RHO = sqrt(1 − Z * Z);
    dec = (360.0/ p2) * atan(Z / RHO);
    ra = (48.0 / p2) * atan(Y / (X + RHO));
    if (ra <0) ra += 24;
    suneq[0] = dec;
    suneq[1] = ra;
    return suneq;
• returns the geocentric right ascension a and declination in an array
moon
    double p2 = 6.283185307, arc = 206264.8062, coseps = 0.91748,
    sineps = 0.39778;
    double LO, L, LS, F, D, H, S, N, DL, CB, L_moon, B_moon, V,
    W, X, V. Z, RHO, ra, dec;
    LO = frac(0.606433 + 1336.855225 * t); mean longitude of moon
    L = p2 * frac(0.374897 + 1325.552410 * t); mean anomaly of Moon
```

-continued

```
LS = p2 * frac(0.993133 + 99.997361 * t); mean anomaly of Sun
D = p2 * frac(0.827361 + 1236.853086 * t); difference in longitude
of moon and sun
F = p2 * frac(0.259086 + 1342.227825 * t); mean argument}
```

The above code may be readily used by a programmer of ordinary skill in the art using a program called Source Code which is incorporated herein in its entirety by reference and a rock chip compiler in order to run the code inside the calculator correctly.

In step 56 the sun's coordinates are calculated and in step 58 the time of sunrise and sunset are calculated for the entered date and location, namely latitude and longitude. However, this calculation is complicated by the fact that the sun is in continued motion with respect to the earth along its ecliptic and its equatorial coordinates. Therefore, in step 60, the calculator calculates the sun's coordinates for the two midnights straddling the required sunrise and sunset and performs an interpellation. The formula is $$T = \frac{24.07 \times ST1}{24.07 + ST1 - ST2}$$

where T is Sideral time rising or setting calculated from alpha 1 and this $xxx_1$ for the midnight before and alpha 2 $xxxx_2$. Details for such calculations are explained in the book "Practical Astronomy with Your Computer" 3rd Edition by Peter Duffett-Smith, published by the Cambridge University Press, Cambridge England. See Section 49 on pp 93-95.

After completing the calculation in block 60 the calculator used in step 62 calculates the sun's azimuth and sunrise and sunset at the previously stated location and date. The sun's azimuth at the selected location and date, together with the times of sunrise and sunset for the selected location are displayed on the calculator screen in step 64. In step 66 for moonrise and moonset the problem of finding the time of moonrise and moonset is complicated by two factors. First, the moon is in rapid motion so that its right ascension and declination are continually changing. As set forth in practical anatomy with your computer by Peter Duffet Smith a way to overcome the problem is to find the moon's coordinates at two different times on the same day and interpolating between them.

A second problem relates to the moon's relatively close proximity to the earth. The coordinates used are correct for the earth's center as opposed to its surface. We can calculate the effect of parallax as set forth in section 70 of the aforementioned text of Peter Duffett-Smith, 3rd Edition, pp. 151-153, that is incorporated herein in its entirety by reference. After determining moonrise and moonset in step 64 an individual enters the moon's right ascension and declination at midnight before and after the specified date using the formula $$T = \frac{12.03 \times ST1}{12.03 + ST1 - ST2}$$

and then in step 66 add corrections for refraction and finite size of the moon's disc.

While the invention has been described in connection with its preferred embodiment it should be recognized that changes and modifications may be made therein without departing from the scope of the appended claims.

What is claimed is:

1. An apparatus for making astronomical calculations consisting of:

a case having a main screen disposed thereon, a plurality of keypad elements for operating said apparatus, said main screen having display parameters of date, latitude, longitude, sunrise, sunset, moonrise, and timezone, the case further including a battery and an on/off switch;

first calculating means for determining the time for sunrise and sunset on a given date at a specified longitude and latitude;

second calculating means for determining the sun's azimuth at sunrise and sunset on said given date at said specified longitude and latitude;

third calculating means for determining the time of moonrise and moonset on said given date and at said specified longitude and latitude;

wherein the calculations are based on the following elements, Julian day, Universal time, Sidereal time, Greenwich Sidereal time, formula for rising and setting of a celestial object, sun's right ascension, and sun's declination, sun's refraction and sun's position;

moonrise and moonset, the formula for rising and setting of a celestial object, geocentric parallax, correction for parallax, moon's right ascension, moon's hourly motion, moon's position and moon's declination; and wherein first calculation for determining the time of sunrise and sunset on a given date at a specified longitude and latitude includes means for calculating the sun's coordinates for the two midnights stradalizing the required sunrise and sunset using the formula $$T = \frac{24.07 \times ST1}{24.07 + ST1 - ST2}$$

wherein T is the actual Sideral time of rising or setting, ST1 is the Sideral Time of rising or setting calculated from X2 appropriate to the midnight before, and S2 is the Sideral time of rising or setting calculated from alpha 2 appropriate to the midnight after; and wherein third calculating means for determining the time of moonrise and moonset on said given date at said specified longitude and latitude include means for calculating the moon's coordinates at two different times on the same day and interpolating between them to determine the required time and calculating r via the value of p' wherein r=60.268,322p' and then calculating the moon's right ascension and declination X 1 and X, at the midnight before the day in question and then using the moon's hourly motion in latitude and longitude to find the coordinates X2 and X2 12 hours later, next the calculating means applies corrections for parallax to both sets of coordinates; the third calculation means uses the corrected set of coordinates and the interpolation formula below to give Sideral time T of moonrise and moonset:

$$T = \frac{12.03 \times ST1}{12.03 + ST1 - ST2}$$

hours and finally the third calculation means applies the correction for refraction and the finite size of the moon's disc; and wherein second calculation means using the following formulas:

$$LST_R = 24 - \frac{1}{15}\text{Cos.}^{-1}(-\text{ten } \phi \text{ ten } 8) + X$$

$$LST_S = \frac{1}{15}\text{Cos.}^{-1}(\text{ten ten } \phi \text{ ten } 8) + X$$

$$A = 360 - \text{Cos.}^{-1}\left(\frac{(\text{Sin}X)}{Cor\phi)}A = \text{Cos}^{-1}\frac{(\text{Sin}X)}{Cor\phi)}A = \text{Cos.}^{-1}\frac{(\text{Sin}X)}{Cor\phi)}\right.$$

wherein the suffixes R and S correspond to rising and setting, A is the azimuth, LST is the local Sideral time in hours X is the right ascesion, X is the declination and $\phi$ is the observers geographical latitude.

* * * * *